US008684183B2

(12) United States Patent
Trannon

(10) Patent No.: US 8,684,183 B2
(45) Date of Patent: Apr. 1, 2014

(54) CARRYING CASE FOR CULINARY ESSENTIALS

(76) Inventor: Vaughn D. Trannon, Las Vegas, NV (US)

( * ) Notice: Subject to any disclaimer, the term of this patent is extended or adjusted under 35 U.S.C. 154(b) by 1370 days.

(21) Appl. No.: 11/610,425

(22) Filed: Dec. 13, 2006

(65) Prior Publication Data

US 2008/0142401 A1 Jun. 19, 2008

(51) Int. Cl.

| | |
|---|---|
| ***A45C 11/00*** | (2006.01) |
| ***B65D 85/00*** | (2006.01) |
| ***B65D 25/28*** | (2006.01) |
| ***B65D 25/02*** | (2006.01) |

(52) U.S. Cl.
USPC ..... 206/553; 206/372; 206/541

(58) Field of Classification Search
USPC ..... 206/553, 757, 735, 810, 223, 576, 581, 206/579, 372, 541–549, 759, 766; 190/115, 190/114, 111, 11, 16, 17, 18 A, 102, 113
See application file for complete search history.

(56) References Cited

U.S. PATENT DOCUMENTS

| | | | | | |
|---|---|---|---|---|---|
| 653,493 | A | * | 7/1900 | Walpuski | 206/553 |
| 1,650,393 | A | * | 11/1927 | Schaefer | 206/553 |
| 2,218,892 | A | | 10/1940 | Ratzlaff | |
| 2,746,505 | A | * | 5/1956 | Howard | 206/757 |
| 2,788,827 | A | * | 4/1957 | Banner | 206/553 |
| 3,904,003 | A | * | 9/1975 | Margerum | 190/11 |
| 4,177,846 | A | * | 12/1979 | Rountree | 206/553 |
| 4,800,108 | A | * | 1/1989 | Swartz | 206/548 |
| 4,979,610 | A | | 12/1990 | Thomas | |
| 5,183,165 | A | | 2/1993 | Acona et al. | |
| 5,240,106 | A | * | 8/1993 | Plath | 190/115 |
| 5,265,719 | A | | 11/1993 | Wand | |
| 5,762,170 | A | * | 6/1998 | Shyr et al. | 190/115 |
| 5,967,270 | A | | 10/1999 | Shyr | |
| 6,102,172 | A | | 8/2000 | Dercole | |
| 6,109,442 | A | | 8/2000 | Roegner | |
| 6,153,857 | A | | 11/2000 | Gunnels | |
| 6,183,133 | B1 | | 2/2001 | Roegner | |
| 6,516,927 | B2 | * | 2/2003 | Krulik | 190/114 |
| 6,619,768 | B1 | | 9/2003 | Northrop et al. | |
| 6,994,194 | B2 | * | 2/2006 | Smith | 190/111 |
| 7,040,486 | B2 | * | 5/2006 | Godshaw et al. | 190/113 |
| 7,331,461 | B2 | * | 2/2008 | MacKinnon | 206/553 |
| 2003/0029770 | A1 | | 2/2003 | MacKinnon | |
| 2003/0106821 | A1 | * | 6/2003 | Bar-Erez | 206/372 |
| 2006/0108240 | A1 | | 5/2006 | MacKinnon | |

FOREIGN PATENT DOCUMENTS

KR 10 2002 0080279 10/2002

* cited by examiner

*Primary Examiner* — Andrew Perreault
(74) *Attorney, Agent, or Firm* — Rob L. Phillips; Greenberg Traurig, LLP

(57) ABSTRACT

Described is a portable carrying case for storing and transporting culinary essentials such as cooking equipment, instruments and accessories such as cutlery, spices, cookbooks, scales and other assortment of kitchen necessities. A knife compartment within said portable carrying case may be detached to serve as a standalone knife retaining compartment.

20 Claims, 5 Drawing Sheets

CARRYING CASE FOR CULINARY ESSENTIALS

FIELD OF THE INVENTION

The embodiments of the present invention relate to carrying cases, more specifically, to a carrying case for storing and transporting culinary essentials such as cooking equipment, instruments and accessories.

BACKGROUND

People engaged in the culinary arts sometimes have the need to store and transport the tools of their trade from location to location. For instance, chefs may need to transport cutlery, spices and other kitchen accessories to various locations for catering operations and culinary expositions. Culinary students may find it necessary to transport cooking instruments between classrooms and the home. Further, culinary professionals, while using a kitchen other than their own, may find it ill-equipped for the desired culinary services to be provided by the culinary professional.

Thus, there exists a need for a portable kit or carrying case for storing and transporting culinary essentials such as cooking equipment, instruments and accessories.

SUMMARY

Accordingly, one embodiment of the present invention provides a case for culinary essentials comprising: a housing comprising a front panel, a rear panel and a pair of side panels; and a flap panel extending from the front panel, the rear panel or both the front and the rear panels, said one or more flap panels able to extend across an upper opening in the housing defined by the front panel, the rear panel and the side panels, wherein the front panel, the rear panel, the side panels and/or the one or more flap panels include one or more restraining means for removably retaining the culinary essentials. In other embodiments, the case further includes a retractable telescopic handle, precision rolling wheels and security means for securing the case and its contents.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
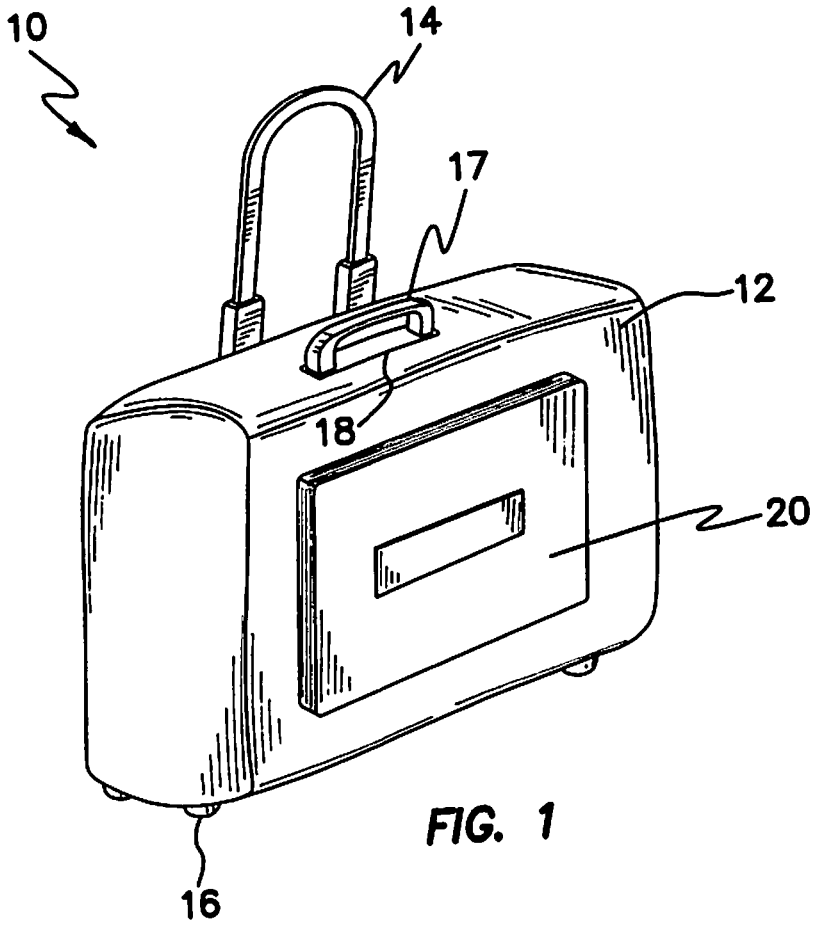
FIG. 1 illustrates a first perspective view of a culinary carrying case according to the embodiments of the present invention.
Figure 2:
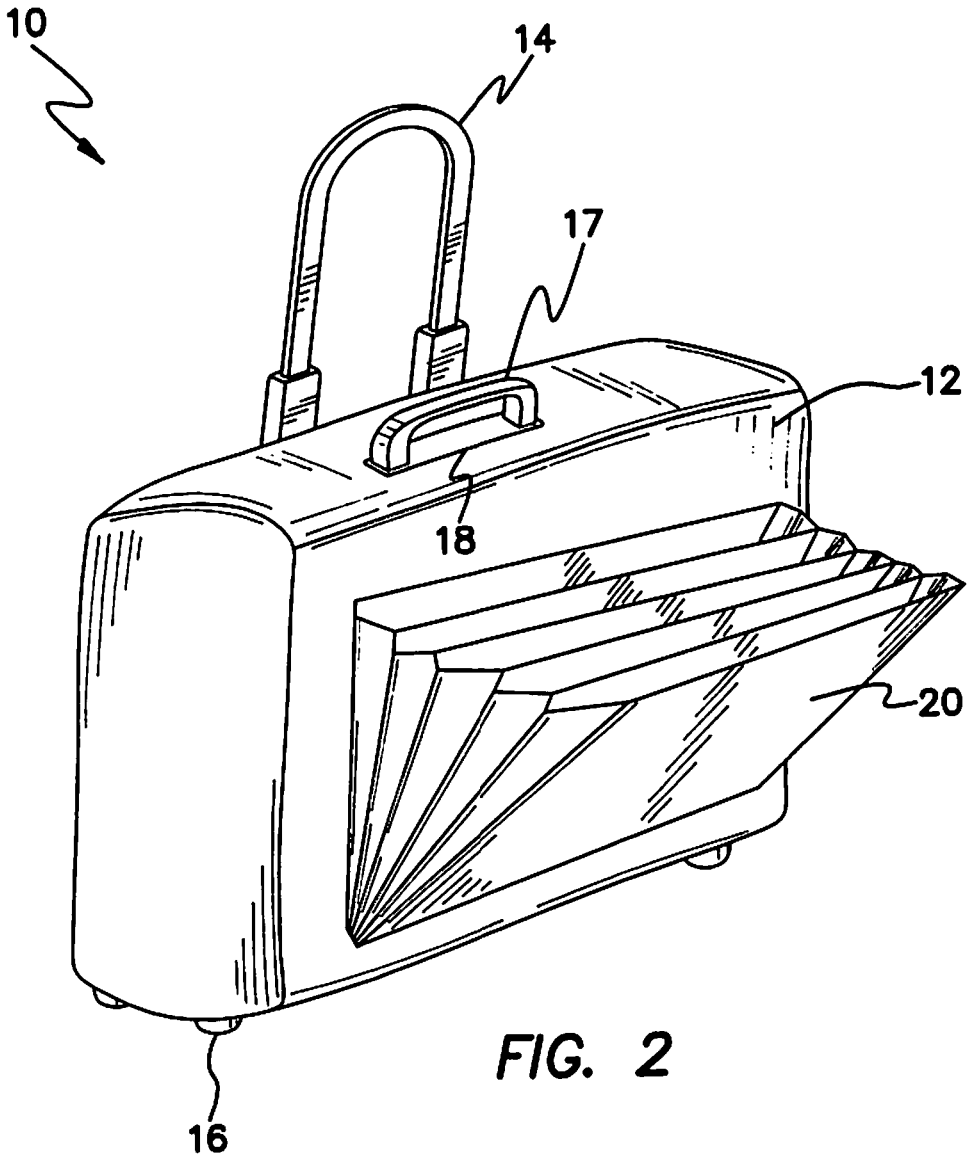
FIG. 2 illustrates a second perspective view of a culinary carrying case according to the embodiments of the present invention.

Initial reference is made to FIGS. 1-2 illustrating perspective views of a culinary carrying case 10, according to the embodiments of the present invention, for use by a culinary practitioner, including dieticians, professional chefs, culinary students, food service workers and any individual that cooks. The culinary carrying case 10 is compact, durable and portable having a flexible rugged housing 12. The interior and exterior of the housing 12 can be made of materials such as cloth, plastic, metal, stainless steel, leather, PVC-coated nylon or synthetic polymers. Ideally, the housing 12 is made from waterproof and corrosion-resistant material to protect against weather hazards such as rain and sleet.

The culinary carrying case 10 includes a rubber-coated handle 17, padded shoulder straps (not shown), a retractable telescopic handle 14, and precision rolling wheels 16 for improved portability and accessibility. The culinary case 10 includes a zip down accordion fan file compartment 20 for storing calculators, business cards, pens, pencils, media, cell phones, recipes, magazines, cookbooks or other small devices, supplies and references. Ideally, the compartment 20 is padded to minimize shock and damage from external forces. As illustrated, FIG. 1 shows the compartment 20 in a closed position while FIG. 2 shows the compartment 20 in an open position. The compartment 20 can also be used to store a notebook computer and may function as a business organizer.

As will be appreciated by one skilled in the art, the size and shape of the housing 12 and the compartment 20 can be customized as necessary to accommodate the culinary practitioner in storing and transporting his or her culinary essentials. The culinary carrying case 10 can be secured with a dual combination lock 18 or other known security methods and systems. For security reasons, the compartment 20 can also be secured with similar security methods and systems.

Figure 3:
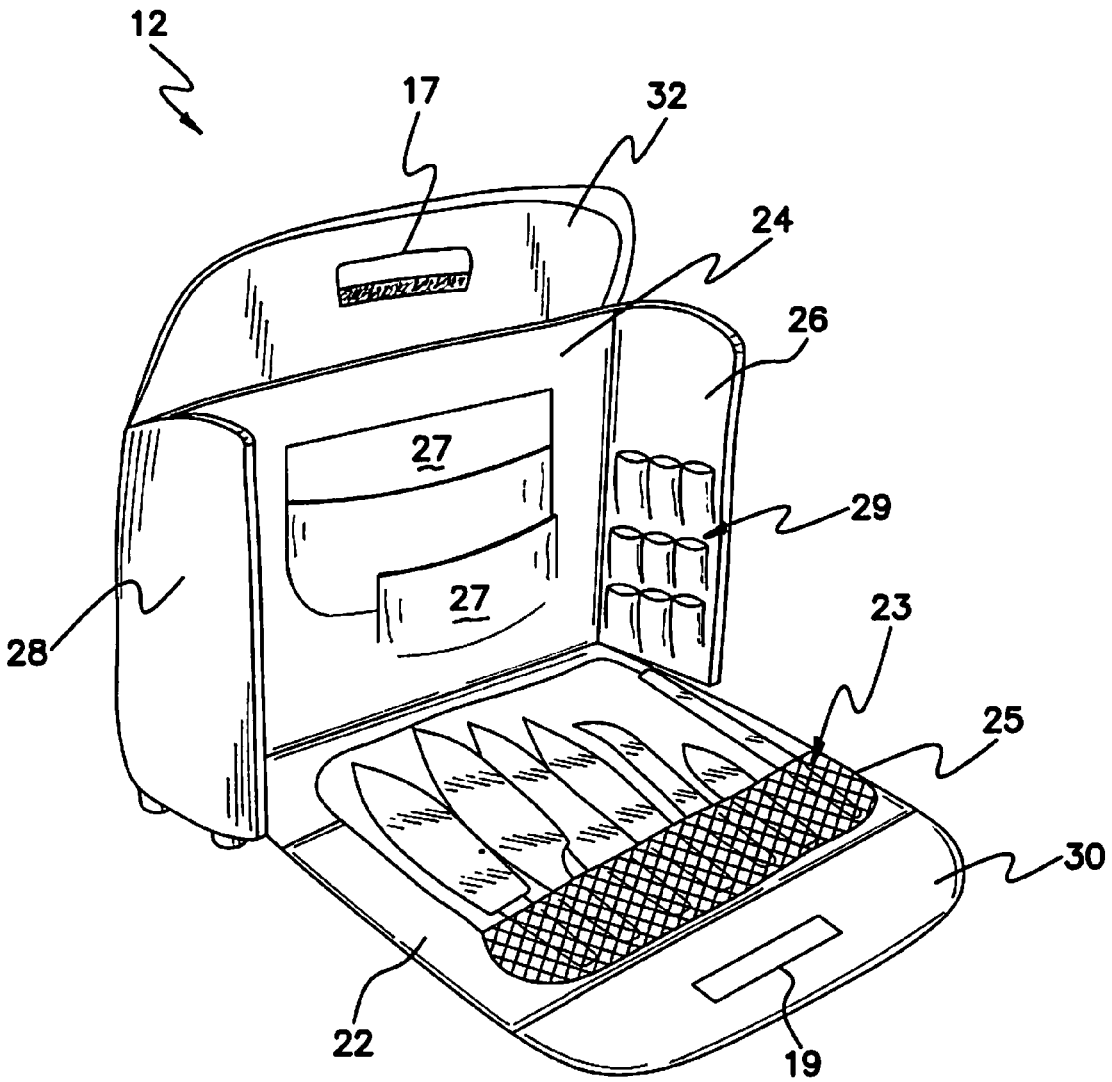
FIG. 3 illustrates a first interior perspective view of a culinary carrying case according to the embodiments of the present invention.
Figure 4:
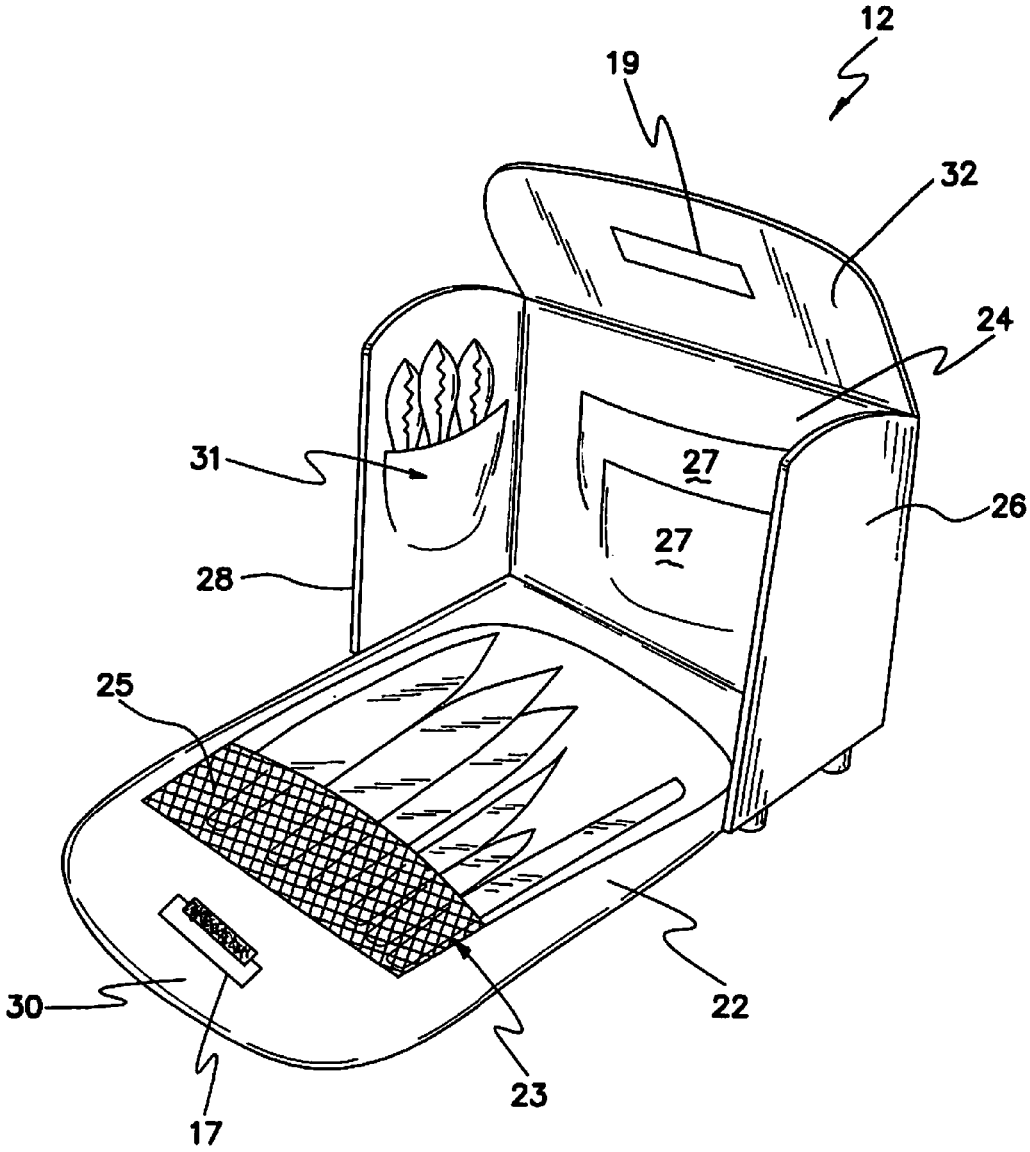
FIG. 4 illustrates a second interior perspective view of a culinary carrying case according to the embodiments of the present invention.

Reference is now made to FIGS. 3-4 illustrating interior perspective views of the housing 12 having a front panel 22, a rear panel 24, a pair of side panels 26, 28 and flap panels 30, 32. The flap panels 30, 32 are shown extending from the front panel 22 and the rear panel 24. The two flap panels 30, 32 overlap when the culinary carrying case 10 is closed. The rubber-coated handle 17 is attached to either flap panel 30, 32 and, if both flap panels 30, 32 are utilized, one of the flap panels 30, 32 may include an opening 19 for the handle 17 to extend therethrough. The front panel 22 includes zipper assemblies (not shown) along its edges allowing the front panel 22 to pivot from a vertical closed position when zipped to a substantially horizontal open position when unzipped. In addition to zipper assemblies, other known fastening systems may be utilized including Velcro®, snaps and buttons. For security reasons, the zipper assemblies may be locked by known methods and systems.

As shown in FIGS. 3-4, an interior portion of the front panel 22 includes compartments 23 for storing an assortment of cutlery and other accessories including graters, thermometers, zesters, reamers, melon ballers and paring knives, the cutlery and accessories being secured by mesh pouches 25. The cutlery and accessories can also be held in place by other known fastening methods such as adjustable tie-straps, zippered mesh compartments, zippered interior sleeves, or magnets. Although the compartments 23 can be attached to the front panel 22 using Velcro®, zippers, or other known fastening methods, it will be appreciated by those skilled in the art that the compartments 23 can be removably detached from the front panel 22 and used as a portable standalone unit. In other words, a user can travel with only the compartments 23 having the cutlery and accessories by rolling or folding the compartments 23 into his or her briefcase or luggage.

An interior portion of the rear panel 24 may include elastic pockets, padded sleeves and/or compartments 27 for storing kitchen accessories such as a cutting board. An interior portion of one of the side panels 26 may include pouches and/or organizer pockets 29 for storing herbs, spices, dressings, and other condiments, while an interior portion of the opposite side panel 28 may include pouches and organizer pockets 31 for storing tongs, knife sharpeners, whisks, spatulas, mesh sheath, and other kitchen utensils having a handle.

Figure 5:
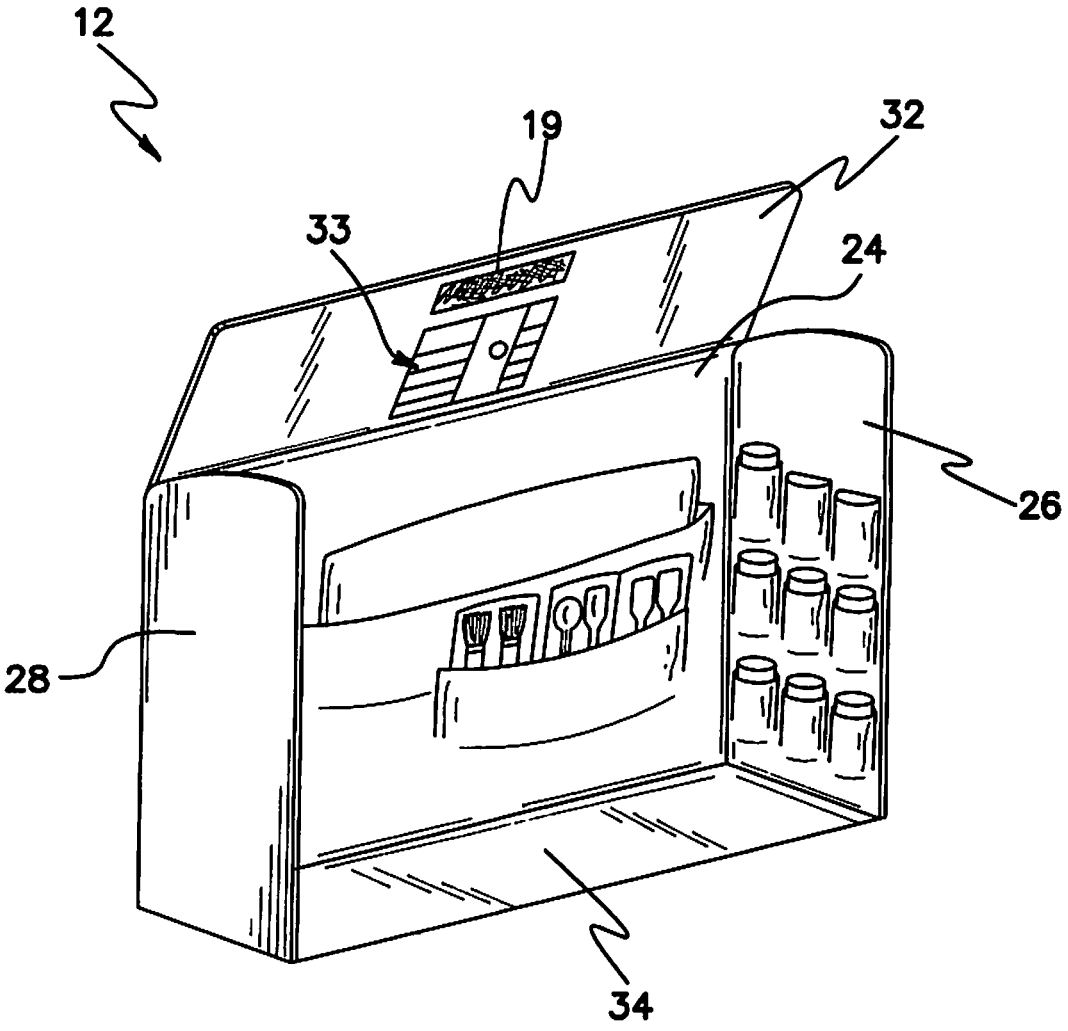
FIG. 5 illustrates a third interior perspective view of a culinary carrying case according to the embodiments of the present invention.

Reference is now made to FIG. 5 illustrating yet another interior perspective view of the housing 12 with the front panel 22 removed. As shown, the flap panel 32 attached to the rear panel 24 includes organizer pockets 33 for storing a garnishing kit, other spices, and a plurality of cooking accessories. One skilled in the art will also appreciate that a storage compartment 34 can be further defined by the front panel 22, rear panel 24, side panels 26, 28, and the flap panel 30. The storage compartment 34 is also capable of storing and transporting a plurality of culinary equipment, instruments or accessories. The size and shape of the storage compartment 34 can be customized based on the size and shape of the panels 22, 24, 26, 28, 30, and can be as large or as small as desired.

The culinary carrying case 10 allows dieticians to travel to their client's kitchen or do research with all the culinary essentials needed to provide a complete dietetic analysis including the use of scales, cutlery, herbs, thongs, sterile gloves, garnish kit, filing compartment, cutting board, along with a laptop computer with the latest nutritional software. The culinary carrying case 10 also allows private chefs, professional cooks, executive chefs, and corporate chefs to travel with ease with an organized and well-outfitted carrying case 10. Since cooks and chefs take great pride in their culinary tools, including their cutlery, the culinary carrying case 10 allows each chef to personalize his or her case with their favorite cutlery, spices or herbs, and leave plenty of room for essentials such as laptop computers, cutting boards, Madeleine, sauté pans, recipes, cooking magazines and cookbooks. The culinary carrying case 10 will transform and revolutionize how culinary students prepare for classes, cooking contests or lab assignments. Students now have the mobility to move between classrooms while caring for their cooking essentials with ease. Students are also able to customize their carrying case with their favorite cutlery, garnish tools, scales, spices, herbs, recipes and cookbooks. In addition, the culinary carrying case 10 also allows any individual who cooks and takes pride in their cutlery, favorite spices and herbs, to outfit the culinary carrying case 10 with their cooking essentials for family outings such as camping trips, backyard BBQs, family picnics and road trips. In other words, the culinary carrying case 10 allows any user to customize the case 10 to his or her own personal needs and desires. In another instance, the carrying case 10 can be utilized by a bartender, a mixologist or anyone that mixes drinks or cocktails for living or for fun. The mixologist can utilize the carrying case 10 to store and transport the proper garnishing kit, paring knives, reamers and other necessary utensils in preparation of mixing the drink or cocktail. Furthermore, the mixologist can utilize the storage compartment 34 of the carrying case 10 for storing and transporting mixers, shakers and spirits.

One skilled in the art will appreciate that pockets, sleeves, slots, panels and compartments and any other storage areas described herein are interchangeable and not restrictive of the invention.

Although the invention has been described in detail with reference to several embodiments, additional variations and modifications exist within the scope and spirit of the invention as described and defined in the following claims.

I claim:

1. A case for culinary essentials comprising:

a housing comprising a front panel, a rear panel and a pair of side panels;

one or more flap panels extending from the front panel, the rear panel or both the front and the rear panels, said one or more flap panels able to extend across an upper opening in the housing defined by the front panel, the rear panel and the side panels, wherein at least one of the front panel, the rear panel, the side panels and the one or more flap panels include one or more restraining means for removably retaining the culinary essentials; and a detachable knife restraining compartment allowing said knife restraining compartment to be used independently of said case, said knife restraining compartment configured with a single pocket extending along a substantially entire bottom portion thereof to restrain multiple knives by handles in a side-by-side relationship and fabricated of a material allowing said knife restraining compartment to be rolled or folded into a self-contained unit while restraining said multiple knives.

2. The case of claim 1, wherein the restraining means include pockets, sleeves, slots, panels and compartments.

3. The case of claim 1, further comprising a retractable telescopic handle.

4. The case of claim 1, further comprising precision rolling wheels.

5. The case of claim 1, further comprising security means for securing the case.

6. The case of claim 1, wherein the case is constructed of waterproof and corrosion resistant material.

7. The case of claim 1, wherein the culinary essentials include cooking equipment, instruments and accessories.

8. The case of claim 1, further comprising an external zip down accordion fan file on an outer surface of at least one of the front and rear panel.

9. A case for culinary essentials comprising:

a housing comprising a front panel, a rear panel and a pair of side panels;

a retractable telescopic handle and precision rolling wheels attached to the housing;

one or more flap panels wherein a flap panel extends from the front panel or the rear panel, or a flap panel extends from both the front panel and the rear panel, wherein each said flap panel is configured to extend across an upper opening in the housing as defined by the front panel, the rear panel and the side panels, wherein the front panel, the rear panel, the side panels and the one or more flap panels each include one or more restraining means for removably retaining the culinary essentials; and a detachable knife restraining compartment allowing said knife restraining compartment to be used independently of said case, said knife restraining compartment configured with a single pocket extending along a substantially entire bottom portion thereof to restrain multiple knives by handles in a side-by-side relationship and fabricated of a material allowing said knife restraining compartment to be rolled or folded into a self-contained unit while restraining said multiple knives.

10. The case of claim 9, wherein the restraining means include pockets, sleeves, slots, panels and compartments.

11. The case of claim 9, further comprising locking means for securing the case.

12. The case of claim 9, wherein the case is constructed of waterproof and corrosion resistant material.

13. The case of claim 9, wherein the culinary essentials include cooking equipment, instruments and accessories.

14. The case of claim 9, further comprising an external zip down accordion fan file on an outer surface of at least one of the front and rear panel.

15. A case for culinary essentials comprising:

a housing comprising a front panel, a rear panel and a pair of side panels;

one or more flap panels wherein a flap panel extends from the front panel or the rear panel, or a flap panel extends from both the front panel and the rear panel, said one or more flap panels configured to extend across an upper opening in the housing defined by the front panel, the rear panel and the side panels, wherein the front panel, the rear panel, the side panels and the one or more flap panels each include one or more restraining means for removably retaining the culinary essentials;

an external zip down accordion fan file on an outer surface of the front and/or rear panel; and a detachable knife restraining compartment allowing said knife restraining compartment to be used independently of said case, said knife restraining compartment configured with a single pocket extending along an entire bottom portion thereof to restrain multiple knives by handles in a side-by-side relationship and fabricated of a material allowing said knife restraining compartment to be rolled or folded into a self-contained unit while restraining said multiple knives.

16. The case of claim 15, wherein the case is constructed of waterproof and corrosion resistant material.

17. The case of claim 15, wherein the culinary essentials include cooking equipment, instruments and accessories.

18. The case of claim 17, wherein the cooking equipment include cutting boards, thermometers, Madeleine pans, garnish kit, herbs and spices.

19. The case of claim 17, wherein the cooking instruments include cutlery, graters, zesters, reamers, melon ballers, paring knives, tongs, knife sharpeners, whisks, spatulas, mesh sheath, and other kitchen utensils having a handle.

20. The case of claim 17, wherein the cooking accessories include calculators, scales, business cards, pens, pencils, media, cell phones, recipes, magazines, cookbooks, laptop computer, and other small devices, supplies and references.

* * * * *